US008773332B2

(12) United States Patent
Nieh et al.

(10) Patent No.: US 8,773,332 B2
(45) Date of Patent: Jul. 8, 2014

(54) DRIVING CIRCUIT FOR PIXELS OF AN ACTIVE MATRIX ORGANIC LIGHT-EMITTING DIODE DISPLAY AND METHOD FOR DRIVING PIXELS OF AN ACTIVE MATRIX ORGANIC LIGHT-EMITTING DIODE DISPLAY

(75) Inventors: Chien-Ming Nieh, Hsin-Chu (TW); Tsung-Ting Tsai, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 468 days.

(21) Appl. No.: 13/071,510

(22) Filed: Mar. 25, 2011

(65) Prior Publication Data

US 2012/0098810 A1 Apr. 26, 2012

(30) Foreign Application Priority Data

Oct. 22, 2010 (TW) ..... 99136144 A

(51) Int. Cl.

| | |
|---|---|
| ***G09G 3/30*** | (2006.01) |
| ***G09G 3/12*** | (2006.01) |
| ***G09G 3/16*** | (2006.01) |

(52) U.S. Cl.

USPC ..... 345/76; 345/36; 345/48; 345/77; 345/78

(58) Field of Classification Search

USPC ..... 345/76, 211, 36, 39, 42, 44, 46, 48

See application file for complete search history.

(56) References Cited

U.S. PATENT DOCUMENTS

| | | | | |
|---|---|---|---|---|
| 6,229,506 | B1 * | 5/2001 | Dawson et al. | 345/82 |
| 7,173,590 | B2 * | 2/2007 | Uchino et al. | 345/92 |
| 7,277,071 | B2 * | 10/2007 | Oh | 345/76 |
| 7,450,092 | B2 | 11/2008 | Kim | |
| 7,649,515 | B2 * | 1/2010 | Ozawa et al. | 345/82 |
| 2004/0046719 | A1 * | 3/2004 | Wang et al. | 345/82 |
| 2004/0201557 | A1 * | 10/2004 | Lo et al. | 345/82 |
| 2005/0052377 | A1 * | 3/2005 | Hsueh | 345/82 |
| 2005/0206591 | A1 * | 9/2005 | Wang et al. | 345/76 |
| 2005/0237283 | A1 * | 10/2005 | Ozawa et al. | 345/76 |
| 2007/0024543 | A1 * | 2/2007 | Chung et al. | 345/76 |
| 2009/0225011 | A1 * | 9/2009 | Choi | 345/77 |
| 2009/0309516 | A1 * | 12/2009 | Kim | 315/307 |
| 2010/0220093 | A1 * | 9/2010 | Choi | 345/213 |
| 2011/0134153 | A1 | 6/2011 | Uchino | |
| 2011/0254883 | A1 | 10/2011 | Tsai | |

FOREIGN PATENT DOCUMENTS

| | | |
|---|---|---|
| CN | 101097677 A | 1/2008 |
| CN | 101866619 A | 10/2010 |

* cited by examiner

*Primary Examiner* — Joe H Cheng
*Assistant Examiner* — Benyam Ketema
(74) *Attorney, Agent, or Firm* — Winston Hsu; Scott Margo

(57) ABSTRACT

A method for driving pixels of an active matrix organic light-emitting diode display is disclosed. The method includes charging a first terminal and a second terminal of a first capacitor with a reference voltage and a reset voltage respectively, and turning on a third switch simultaneously, floating the second terminal of the first capacitor, charging the first terminal of the first capacitor according to a data voltage, floating the first terminal of the first capacitor and turning on the third switch. Thus, determine a driving current independent of process variances of the N-type thin film transistor and a voltage drop of an OLED according to a difference voltage across the first capacitor.

18 Claims, 14 Drawing Sheets

DRIVING CIRCUIT FOR PIXELS OF AN ACTIVE MATRIX ORGANIC LIGHT-EMITTING DIODE DISPLAY AND METHOD FOR DRIVING PIXELS OF AN ACTIVE MATRIX ORGANIC LIGHT-EMITTING DIODE DISPLAY

BACKGROUND OF THE INVENTION

1. Field of the Invention

The present invention is related to a driving circuit for pixels of an active matrix organic light-emitting diode display and a method for driving pixels of an active matrix organic light-emitting diode display, and particularly to a driving circuit for pixels of an active matrix organic light-emitting diode display and a method for driving pixels of an active matrix organic light-emitting diode display that are independent of process variation of a thin film transistor and voltage drop of an organic light-emitting diode.

2. Description of the Prior Art

A metal line of a common low-voltage terminal of a driving circuit for pixels of an active matrix organic light-emitting diode (AMOLED) display has an impedance, therefore voltages of source terminals of N-type thin film transistors for driving different organic light-emitting diodes may be different from each other, which would cause driving currents flowing through the different organic light-emitting diodes to be different from each other. Luminance of the organic light-emitting diode is controlled by the driving current, so the different driving currents cause uneven luminance of a panel.

Further, due to process variation during fabrication of the thin film transistor, threshold voltages (VTH) of the thin film transistors driving the organic light-emitting diodes may be equal or unequal. Therefore, even if the thin film transistors are given the same data voltage, the driving current generated by the thin film transistors may still be unequal, resulting in the uneven luminance of the panel. In addition, after utilizing the organic light-emitting diode for a period of time, a voltage drop of the organic light-emitting diode is increased due to degradation of the organic light-emitting diode. Because the voltage drop of the organic light-emitting diode is increased, luminance of the organic light-emitting diode given the original data voltage is decreased, resulting in image sticking of the panel.

SUMMARY OF THE INVENTION

An embodiment provides a driving circuit for pixels of an active matrix organic light-emitting diode display. The driving circuit includes a first switch, a second switch, a third switch, an N-type thin film transistor, a first capacitor, and an organic light-emitting diode. The first switch has a first terminal, a second terminal, and a third terminal. The first terminal is used for receiving a reference voltage or a data voltage, and the second terminal is used for receiving a first switch signal. The second switch has a first terminal, a second terminal, and a third terminal. The first terminal is used for receiving a reset voltage, and the second terminal is used for receiving a second switch signal. The third switch has a first terminal, a second terminal, and a third terminal. The first terminal is used for receiving a first voltage, and the second terminal is used for receiving a third switch signal. The N-type thin film transistor has a first terminal, a second terminal, and a third terminal. The first terminal is coupled to the third terminal of the third switch, the second terminal is coupled to the third terminal of the first switch, and the third terminal is coupled to the third terminal of the second switch.

The first capacitor has a first terminal, and a second terminal. The first terminal is coupled to the third terminal of the first switch, and the second terminal is coupled to the third terminal of the second switch. The organic light-emitting diode has a first terminal, and a second terminal. The first terminal is coupled to the third terminal of the N-type thin film transistor, and the second terminal is coupled to a second voltage.

Another embodiment provides a method of driving pixels of the active matrix organic light-emitting diode display. The method includes charging a first terminal of a first capacitor and a second terminal of the first capacitor according to a reference voltage and a reset voltage respectively, and turning on a third switch at the same time, wherein the reference voltage is higher than the reset voltage, floating the second terminal of the first capacitor, charging the first terminal of the first capacitor according to a data voltage and turning off the third switch, and floating the first terminal of the first capacitor and turning on the third switch.

The present invention provides a driving circuit for pixels of an active matrix organic light-emitting diode display and a method for driving pixels of an active matrix organic light-emitting diode display. The driving circuit and the method utilize a driving circuit having four thin film transistors and two capacitors (4T2C) to generate a driving current independent of process variation of the thin film transistor and a voltage drop of an organic light-emitting diode. Therefore, the present invention can reduce differences among the driving currents driving the pixels of the active matrix organic light-emitting diode display to improve decayed luminance of the organic light-emitting diode and uneven luminance of a panel.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
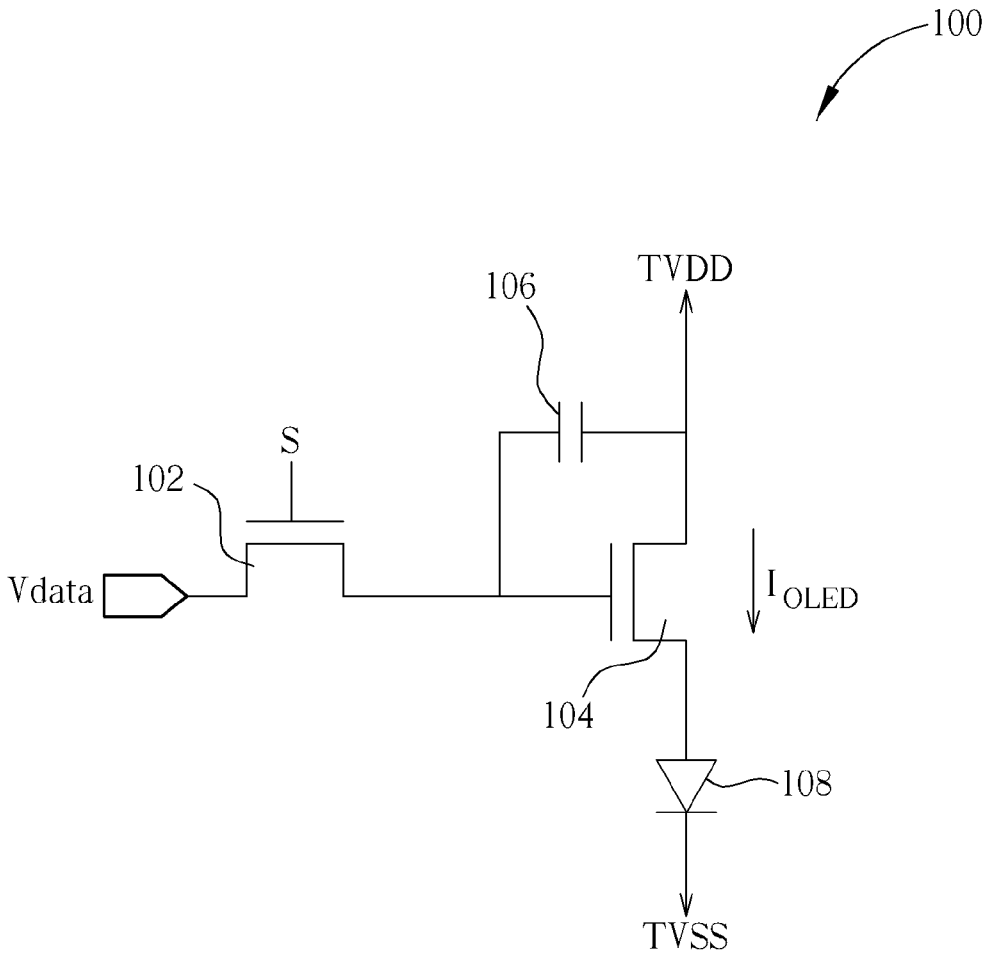
FIG. 1 is a diagram illustrating a driving circuit for pixels of an active matrix organic light-emitting diode display.

Please refer to FIG. 1. FIG. 1 is a diagram illustrating a driving circuit 100 for pixels of an active matrix organic light-emitting diode (AMOLED) display. As shown in FIG. 1, the driving circuit 100 is a 2T1C circuit, which includes two N-type thin film transistors 102, 104, a capacitor 106, and an organic light-emitting diode 108. The N-type thin film transistor 102 is a switch, and the N-type thin film transistor 104 is used for providing a driving current IOLED for the organic light-emitting diode 108, where terminals TVSS of a plurality of driving circuits 100 of a panel are electrically connected to each other, and so are terminals TVDD. When the driving circuit 100 drives a pixel, the driving current IOLED flows to the terminal TVSS of the driving circuit 100.

Figure 2:
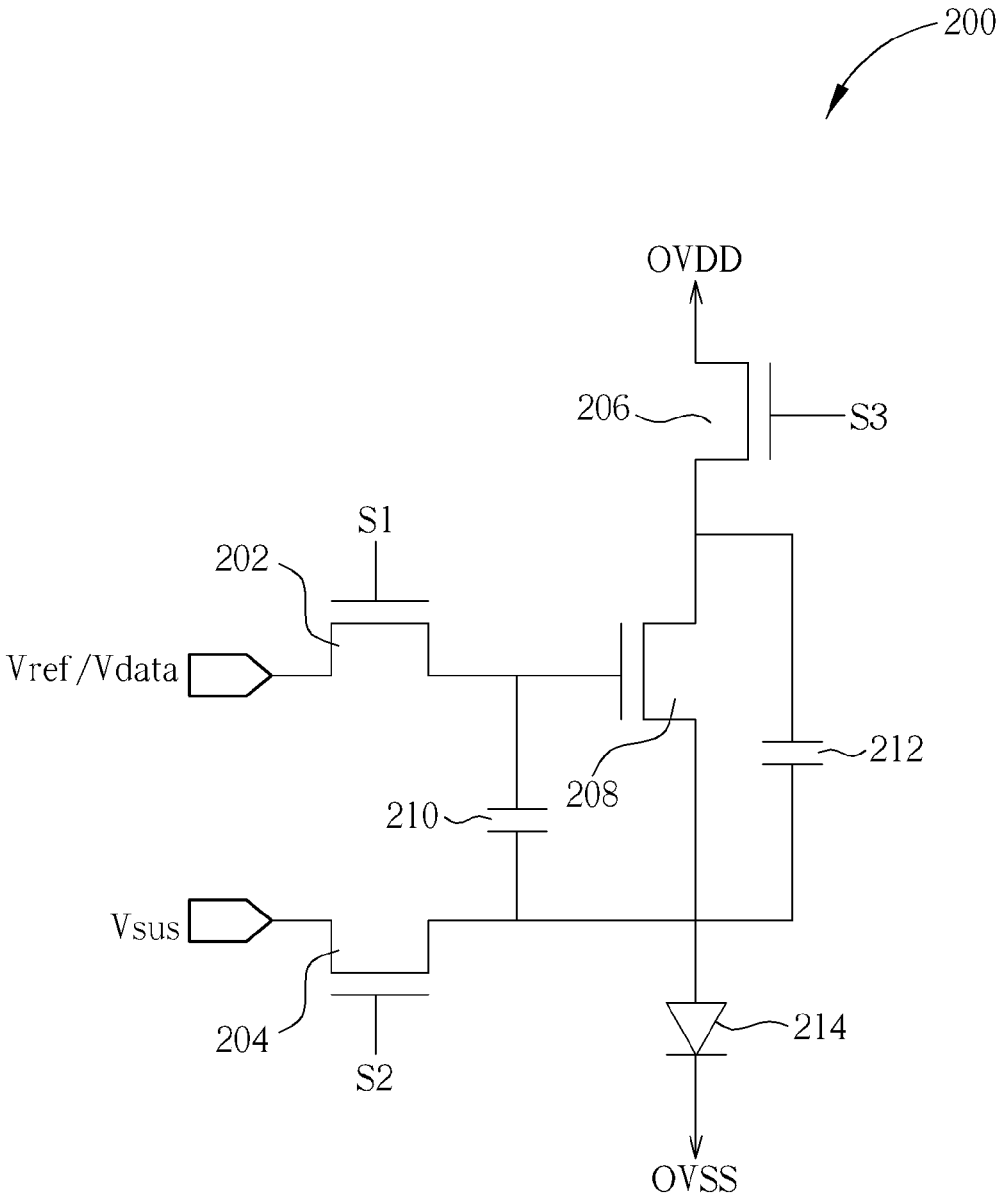
FIG. 2 is a diagram illustrating a driving circuit for pixels of an active matrix organic light-emitting diode display.

Please refer to FIG. 2. FIG. 2 is a diagram illustrating a driving circuit 200 for pixels of an active matrix organic light-emitting diode display. The driving circuit 200 includes a first switch 202, a second switch 204, a third switch 206, an N-type thin film transistor 208, a first capacitor 210, a second capacitor 212, and an organic light-emitting diode 214. The first switch 202 has a first terminal for receiving a reference voltage Vref and a data voltage Vdata, a second terminal for receiving a first switch signal S1, and a third terminal. The second switch 204 has a first terminal for receiving a reset voltage Vsus, a second terminal for receiving a second switch signal S2, and a third terminal, where the reference voltage Vref is higher than the reset voltage Vsus. The third switch 206 has a first terminal for receiving a first voltage OVDD, a second terminal for receiving a third switch signal S3, and a third terminal, where the first switch 202, the second switch 204, and the third switch 206 are all N-type thin film transistors. The N-type thin film transistor 208 has a first terminal coupled to the third terminal of the third switch 206, a second terminal coupled to the third terminal of the first switch 202, and a third terminal coupled to the third terminal of the second switch 204. The first capacitor 210 has a first terminal coupled to the third terminal of the first switch 202, and a second terminal coupled to the third terminal of the second switch 204. The second capacitor 212 has a first terminal coupled to the third terminal of the third switch 206, and a second terminal coupled to the third terminal of the N-type thin film transistor 208. The organic light-emitting diode 214 has a first terminal coupled to the third terminal of the N-type thin film transistor 208, and a second terminal coupled to the second voltage OVSS.

Figure 3:
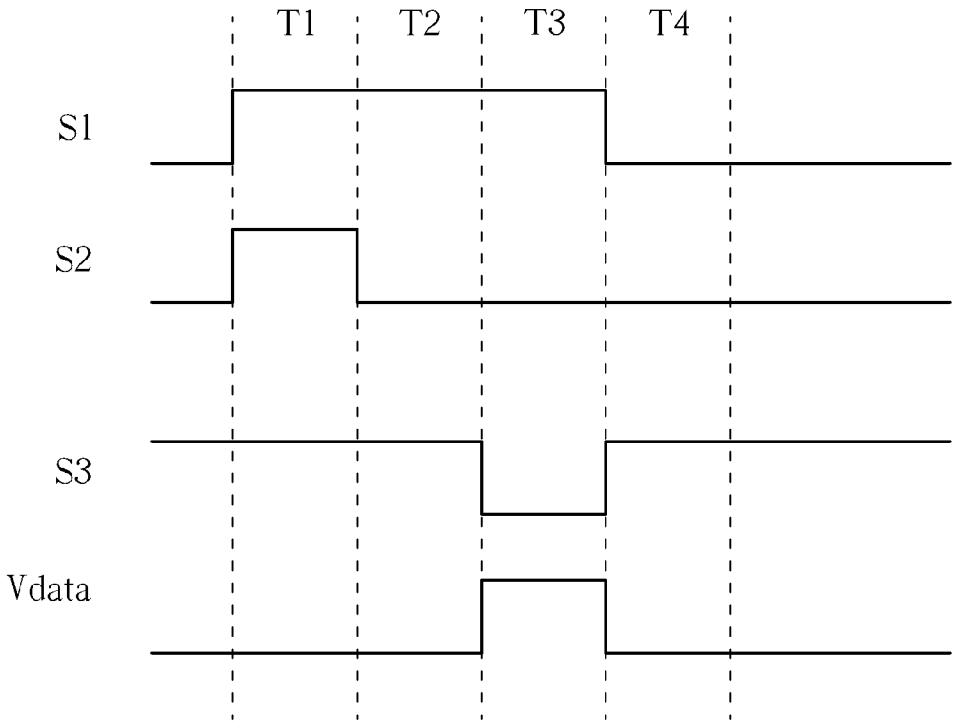
FIG. 3 is a timing diagram illustrating the first switch signal, the second switch signal, and the third switch signal.

Please refer to FIG. 3. FIG. 3 is a timing diagram illustrating the first switch signal S1, the second switch signal S2, and the third switch signal S3. As shown in FIG. 3, the periods of the operations of the first switch signal S1, the second switch signal S2, and the third switch signal S3 are all different.

Figure 4:
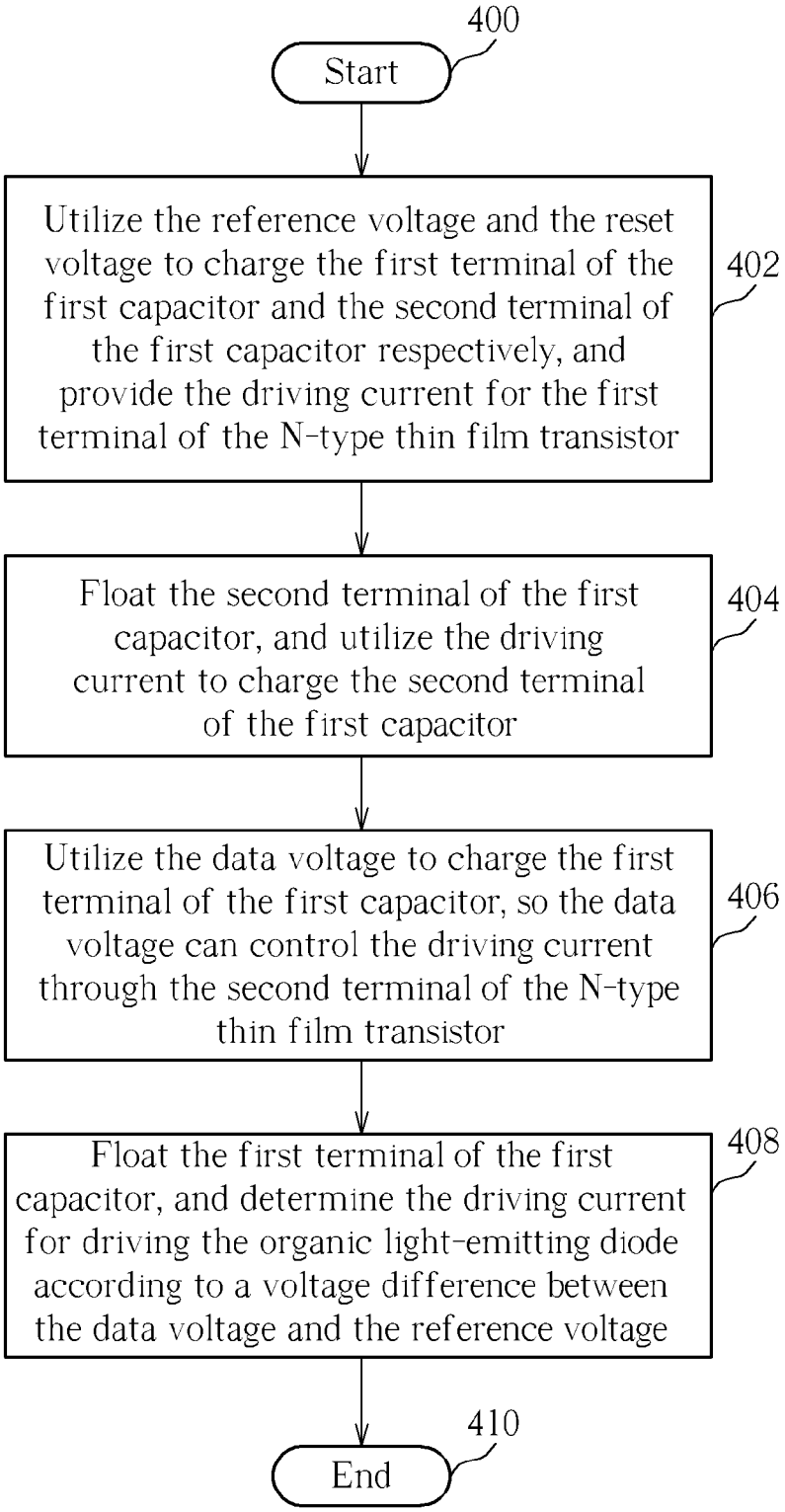
FIG. 4 is a flowchart illustrating a method of driving the active matrix organic light-emitting diode display.

Please refer to FIG. 4. FIG. 4 is a flowchart illustrating a method of driving the active matrix organic light-emitting diode display. The method in FIG. 4 is illustrated with reference to the driving circuit 200 in FIG. 2. Detailed steps are as follows:

Step 400: Start.

Step 402: Utilize the reference voltage Vref and the reset voltage Vsus to charge the first terminal of the first capacitor 210 and the second terminal of the first capacitor 210 respectively, and provide the driving current IOLED for the first terminal of the N-type thin film transistor 208, where the second terminal of the N-type thin film transistor 208 is coupled to the first terminal of the first capacitor 210 and the third terminal of the N-type thin film transistor 208 is coupled to the second terminal of the first capacitor 210.

Step 404: Float the second terminal of the first capacitor 210, and utilize the driving current IOLED to charge the second terminal of the first capacitor 210, while the first capacitor 210 stores a compensation voltage Vt.

Step 406: Utilize the data voltage Vdata to charge the first terminal of the first capacitor 210, so the data voltage Vdata can control the driving current IOLED through the second terminal of the N-type thin film transistor 208.

Step 408: Float the first terminal of the first capacitor 210, and determine the driving current IOLED for driving the organic light-emitting diode 214 according to a voltage difference between the data voltage Vdata and the reference voltage Vref.

Step 410: End.

Figure 5A:
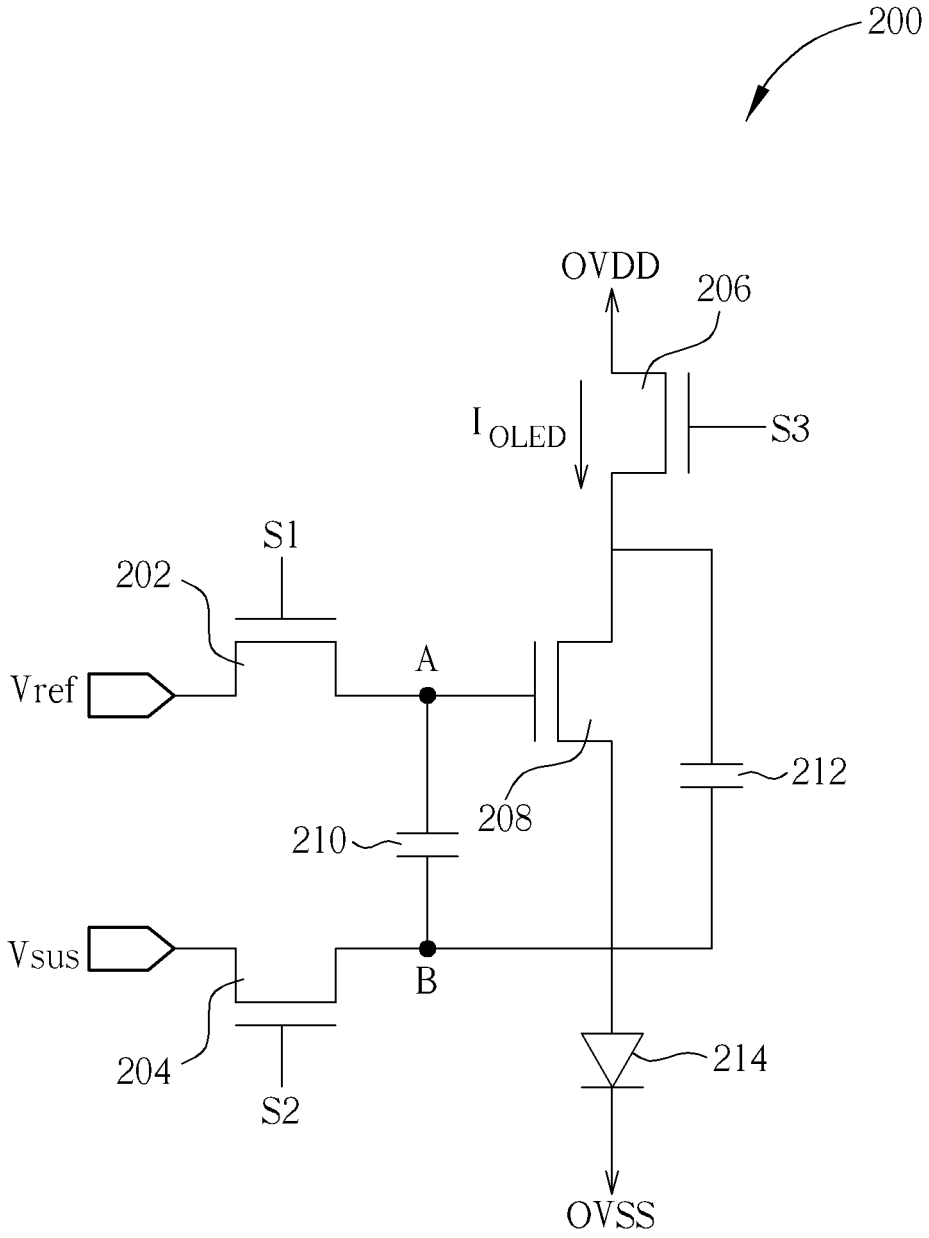
FIG. 5A and FIG. 5B are diagrams illustrating an operation state and a timing of the driving circuit at a first time interval.
Figure 5B:
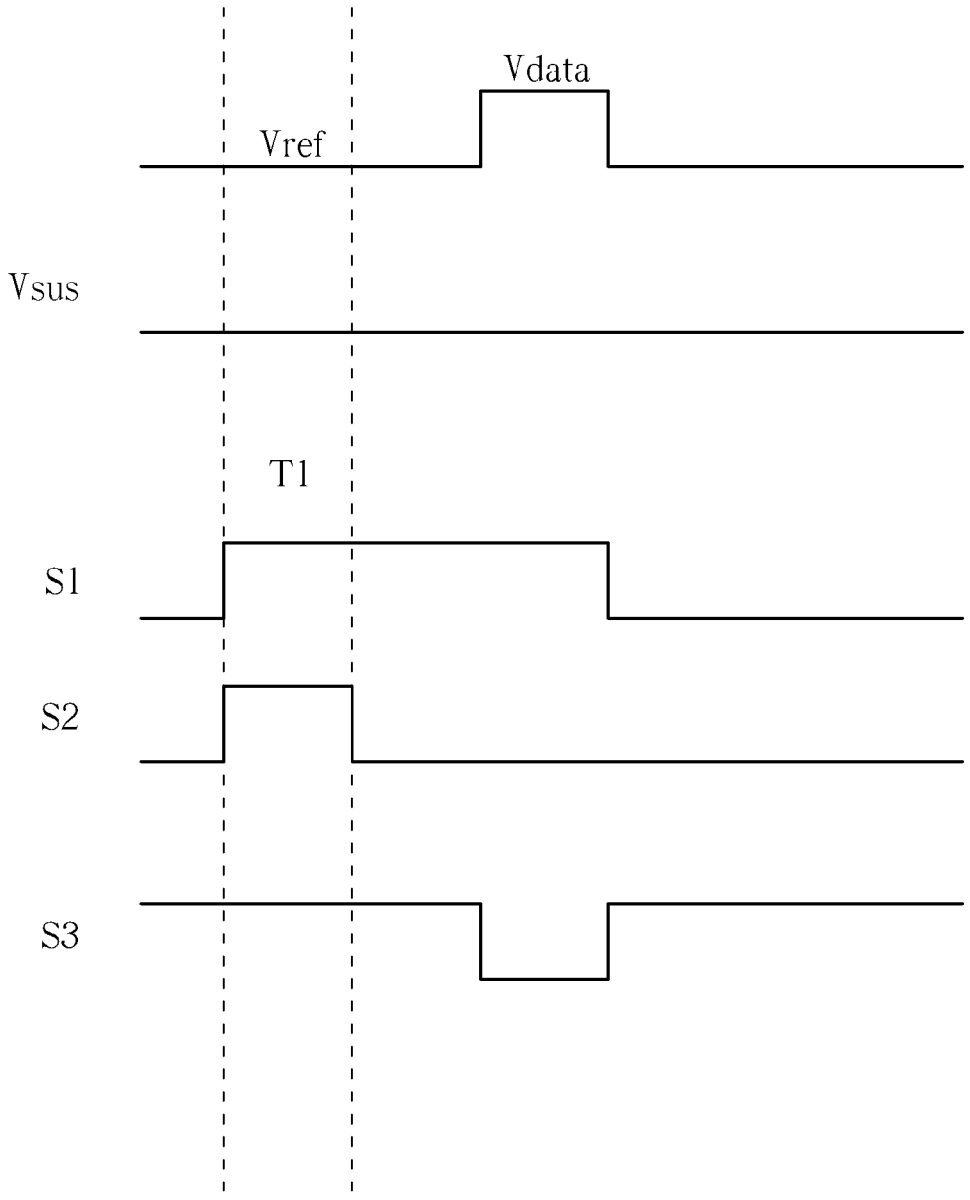

Detailed steps are described as follows:

In Step 402, please refer to FIG. 5A and FIG. 5B. FIG. 5A and FIG. 5B are diagrams illustrating an operation state and a timing of the driving circuit 200 at a first time interval T1. As shown in FIG. 5A and FIG. 5B, because the first switch signal S1, the second switch signal S2, and the third switch signal S3 are at a logic-high voltage, the first switch 202, the second switch 204, and the third switch 206 are turned on. The reference voltage Vref charges the first terminal of the first capacitor 210, the reset voltage Vsus charges the second terminal of the first capacitor 210, and the driving current $I_{OLED}$ flows toward the first terminal of the N-type thin film transistor 208 through the third switch 206, where the reset voltage Vsus is a direct current (DC) voltage. In Step 402, the reference voltage Vref and the reset voltage Vsus are used for resetting voltages of the two terminals of the first capacitor 210 for writing the data voltage Vdata driving a pixel of a new frame. A voltage $V_A$ of a node A is the reference voltage Vref and a voltage $V_B$ of a node B is the reset voltage Vsus.

Figure 6A:
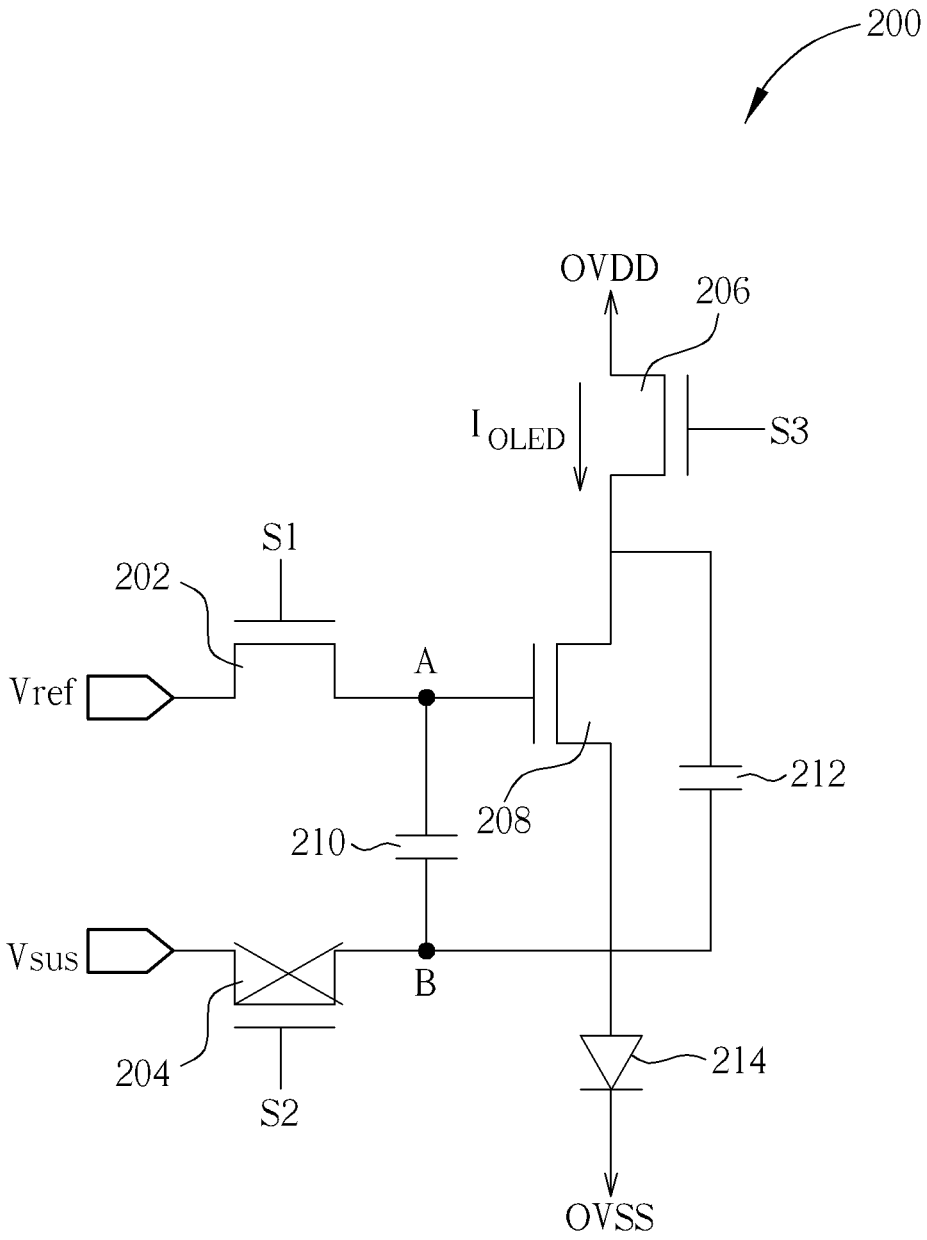
FIG. 6A and FIG. 6B are diagrams illustrating the operation state and the timing of the driving circuit at a second time interval.
Figure 6B:
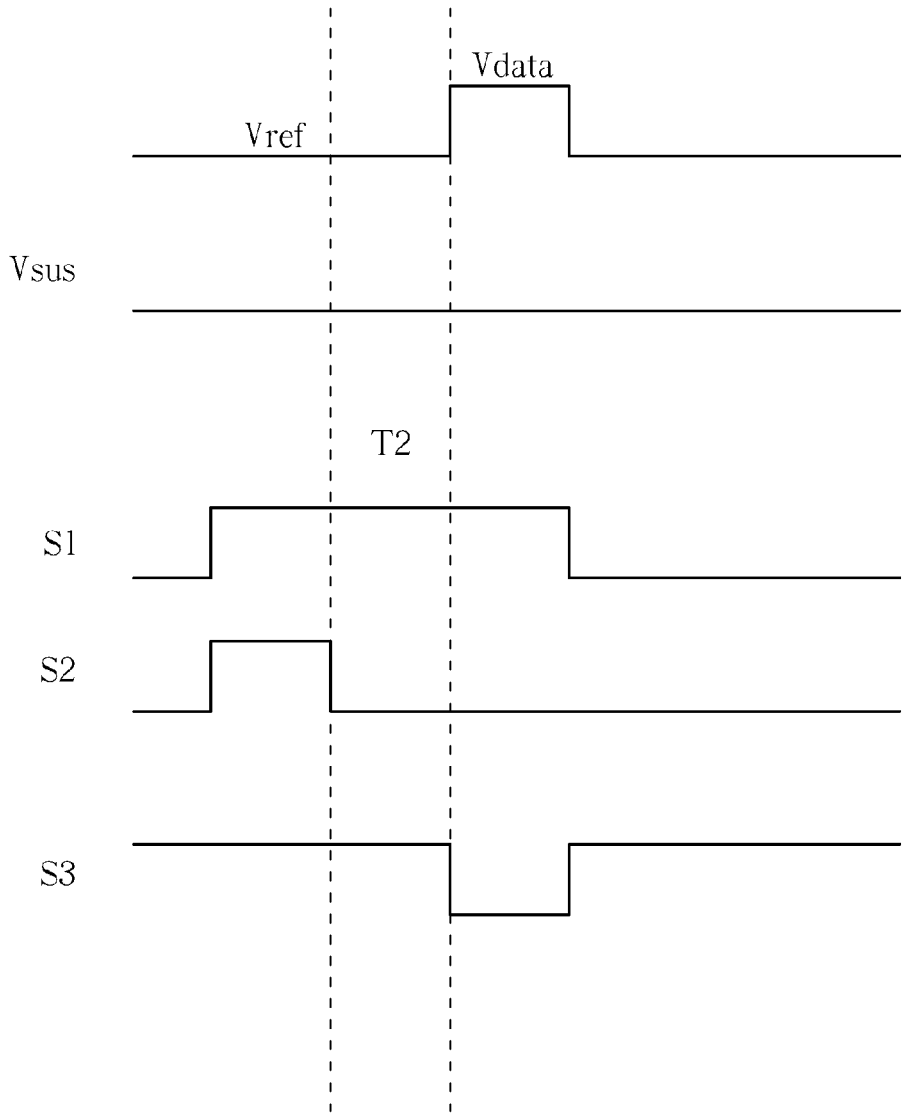

In Step 404, please refer to FIG. 6A and FIG. 6B. FIG. 6A and FIG. 6B are diagrams illustrating the operation state and the timing of the driving circuit 200 at a second time interval T2. As shown in FIG. 6A and FIG. 6B, because the first switch signal S1 is at the logic-high voltage and the second switch signal S2 is at a logic-low voltage, the first switch 202 is turned on and the second switch 204 is turned off. The reference voltage Vref still charges the first terminal of the first capacitor 210 (the voltage $V_A$ is still the reference voltage Vref), and the second terminal of the first capacitor 210 is at a floating state because the second switch 204 is turned off. However, the third switch 206 is still turned on, so the voltage $V_B$ of the node B is determined by the driving current $I_{OLED}$. Therefore, the voltage $V_B$ of the node B is not charged to Vref-Vt by the driving current $I_{OLED}$ until the N-type thin film transistor 208 is turned off. Because a voltage drop between the second terminal and the third terminal of the N-type thin film transistor 208 is Vt, the N-type thin film transistor 208 is turned off, where Vt is a threshold voltage of the N-type thin film transistor 208. The voltage $V_A$ of the node A is the reference voltage Vref, and the voltage $V_B$ of the node B is Vref-Vt, so the first capacitor 210 stores a compensation voltage Vt (that is, the voltage $V_A$ of the node A minus the voltage $V_B$ of the node B).

Figure 7A:
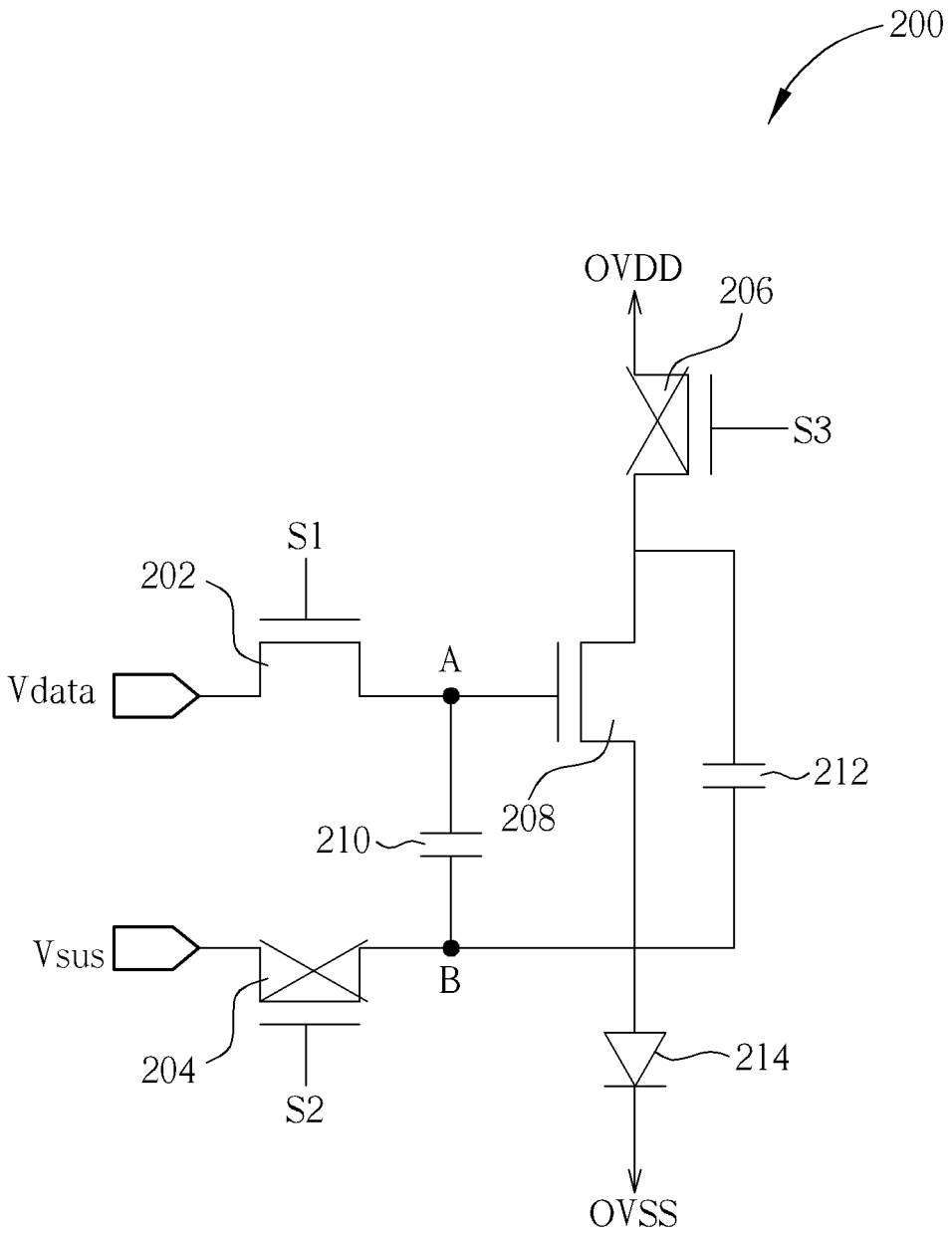
FIG. 7A and FIG. 7B are diagrams illustrating the operation state and the timing of the driving circuit at a third time interval.
Figure 7B:
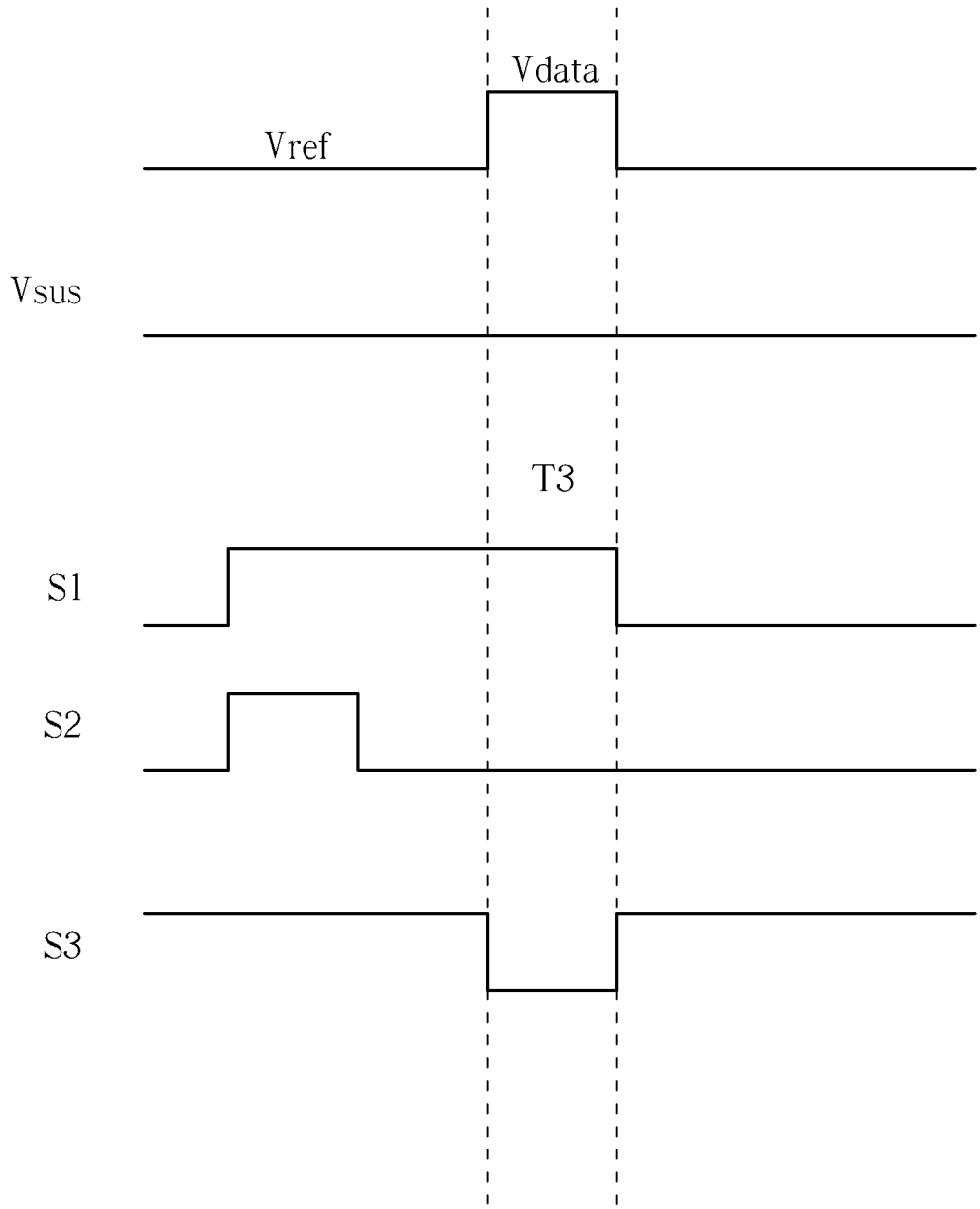

In Step 406, please refer to FIG. 7A and FIG. 7B. FIG. 7A and FIG. 7B are diagrams illustrating the operation state and the timing of the driving circuit 200 at a third time interval T3. As shown in FIG. 7A and FIG. 7B, because the first switch signal S1 is at the logic-high voltage, and the second switch signal S2 and the third switch signal S3 are at the logic-low voltage, the first switch 202 is turned on and the second switch 204 and the third switch 206 are turned off. The data voltage Vdata charges the first terminal of the first capacitor 210 through the first switch 202, and the second terminal of the first capacitor 210 is at the floating state. The data voltage Vdata controls the driving current $I_{OLED}$ through the second terminal of the N-type thin film transistor 208, and the driving current $I_{OLED}$ corresponds to a gray-level of the organic light-emitting diode 214. The voltage $V_A$ of the node A is changed from the reference voltage Vref (at the second time interval T2) to the data voltage Vdata, and the second terminal of the first capacitor 210 is at the floating state, so the voltage $V_B$ ($V_B$ is equal to a voltage $V_S$ of the third terminal of the N-type thin film transistor 208) of the node B is generated according to the following equation:

$$V_B = Vref - Vt + a(Vdata - Vref), \quad a = \frac{C1}{C1 + C2} \tag{1}$$

where C1 is a value of the first capacitor 210 and C2 is a value of the second capacitor 212, and the first capacitor 210 and the second capacitor 212 are used for dividing a variation voltage Vdata-Vref of the second terminal of the N-type thin film transistor 208.

Figure 8A:
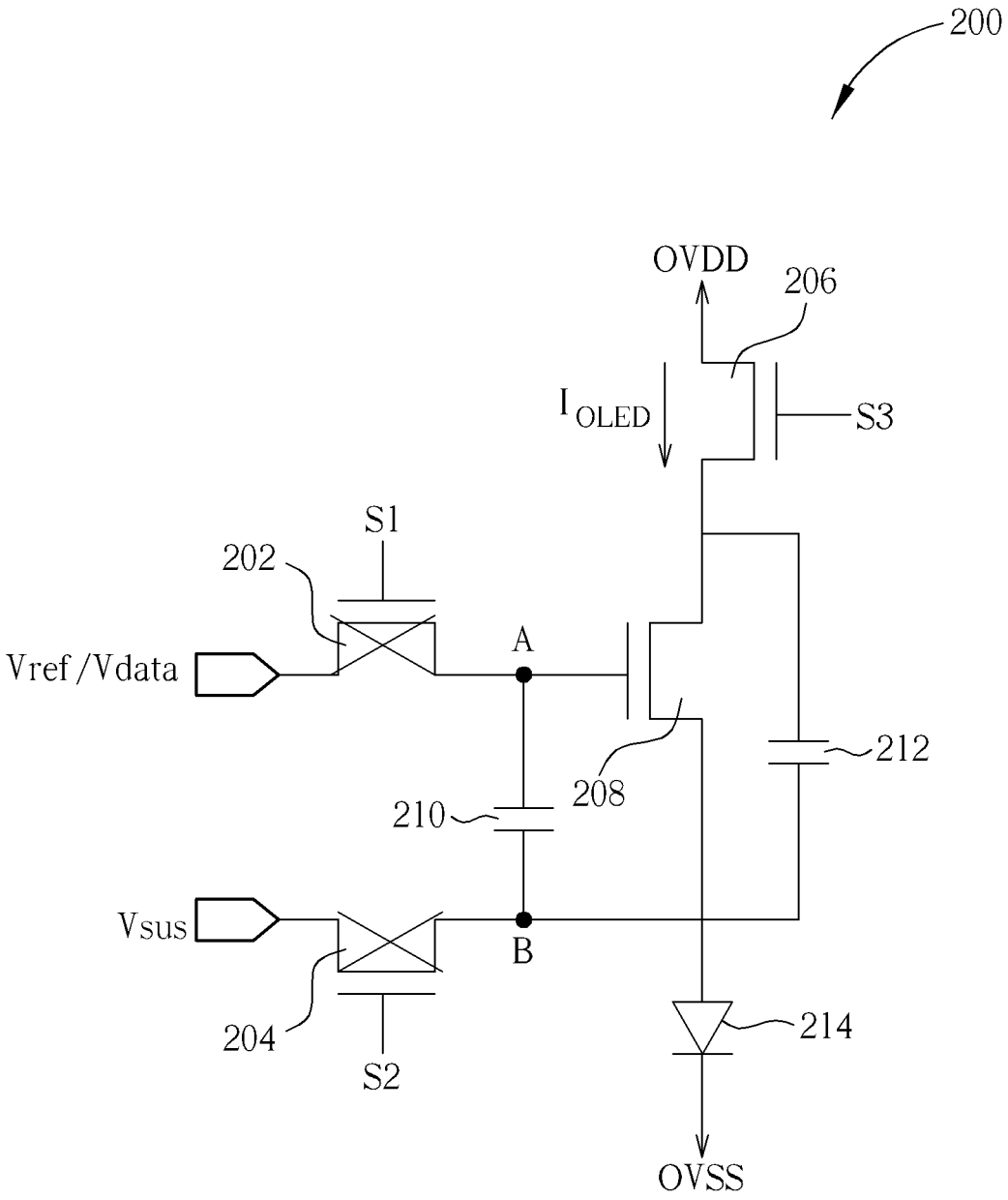
FIG. 8A and FIG. 8B are diagrams illustrating the operation state and the timing of the driving circuit at a fourth time interval.
Figure 8B:
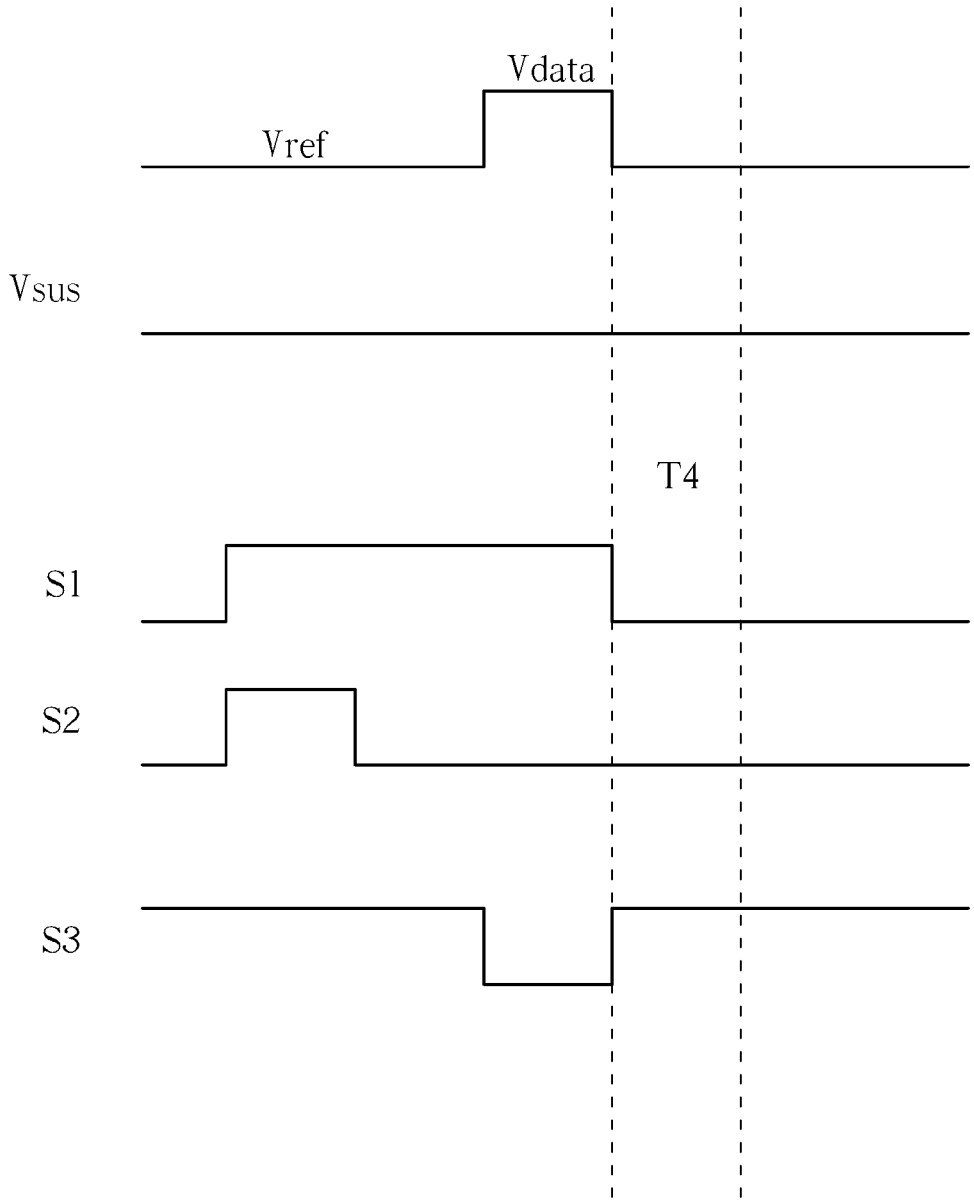

In Step 408, please refer to FIG. 8A and FIG. 8B. FIG. 8A and FIG. 8B are diagrams illustrating the operation state and the timing of the driving circuit 200 at a fourth time interval T4. As shown in FIG. 8A and FIG. 8B, because the first switch signal S1 and the second switch signal S2 are at the logic-low voltage, and the third switch signal S3 is at the logic-high voltage, the first switch 202 and the second switch 204 are turned off and the third switch 206 is turned on. The driving current $I_{OLED}$ drives the organic light-emitting diode 214 through the third switch 206, so a voltage $V_S$ of the third terminal of the N-type thin film transistor 208 is a sum of the second voltage OVSS and a voltage drop VOLED of the organic light-emitting diode 214. Because the first switch 202 is turned off, the second terminal of the N-type thin film transistor 208 is at the floating state in the beginning of the fourth time interval T4, and a voltage $V_G$ (that is, the voltage $V_A$ of the node A) of the second terminal of the N-type thin film transistor 208 is generated according to the following equation:

$$V_G = V\text{data} + Vt - V\text{ref} - a(V\text{data} - V\text{ref}) + \text{OVSS} + \text{VOLED} \tag{2}$$

Because the voltage $V_G$ of the second terminal and the voltage $V_B$ of the third terminal of the N-type thin film transistor 208 are given, a voltage difference $V_{GS}$ between the second terminal and the third terminal of the N-type thin film transistor 208 is generated according to the following equation:

$$\begin{aligned} V_{GS} &= V_G - V_S \\ &= Vdata + Vt - Vref - a(Vdata - Vref) + OVSS + VOLED - \\ &\quad OVSS - VOLED \\ &= (1 - a)(Vdata - Vref) + Vt \end{aligned} \tag{3}$$

The driving current IOLED driving the organic light-emitting diode 214 is generated according to the following equation:

$$I_{OLED} = k(V_{GS} - Vt)^2 = k[(1-a)(V\text{data} - V\text{ref})]^2 \tag{4}$$

As shown in the equation (4), the driving current IOLED flowing through the organic light-emitting diode 214 and the threshold voltage Vt of the N-type thin film transistor 208 are independent of the second voltage OVSS.

Figure 9:
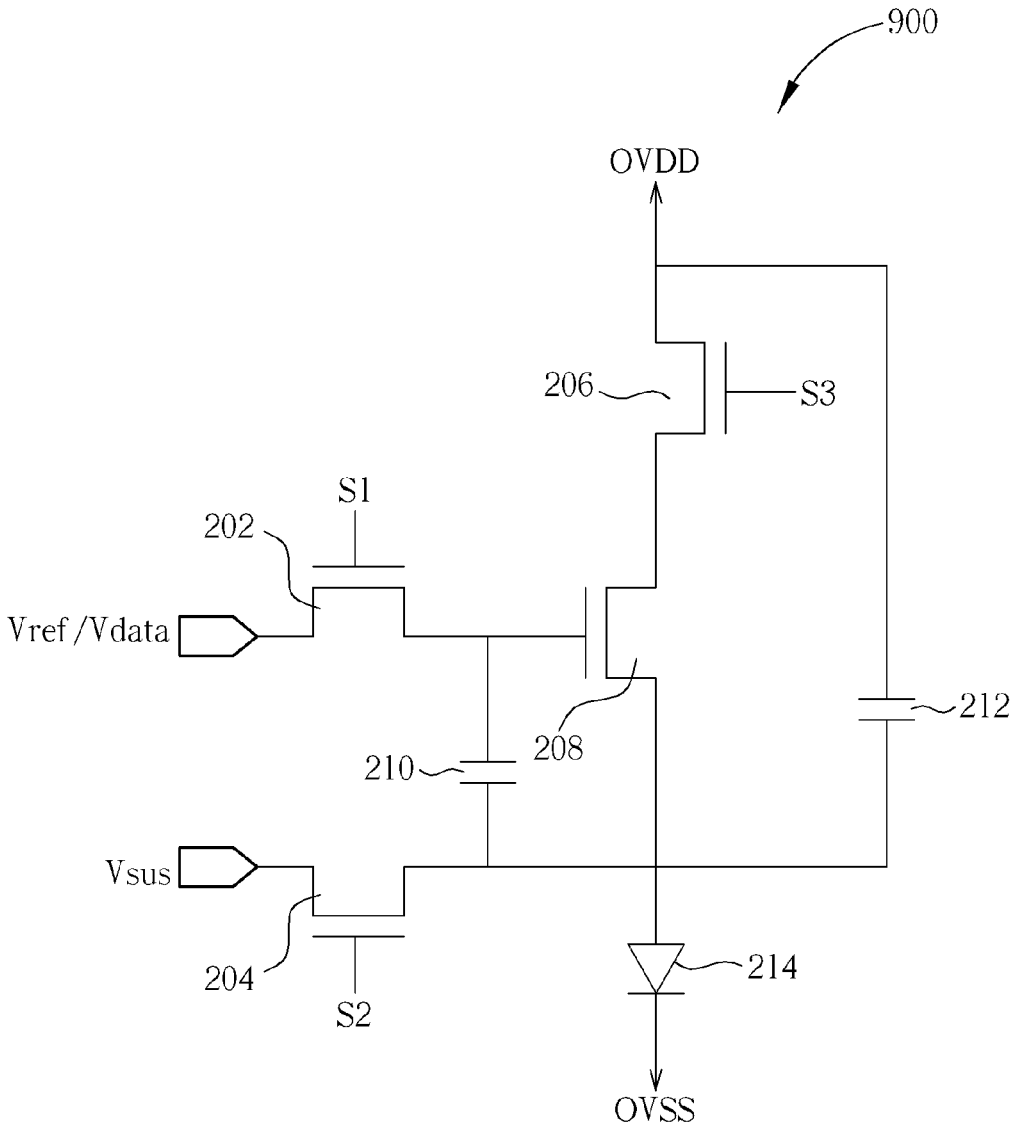
FIG. 9 is a diagram illustrating a driving circuit for pixels of an active matrix organic light-emitting diode display.
Figure 10:
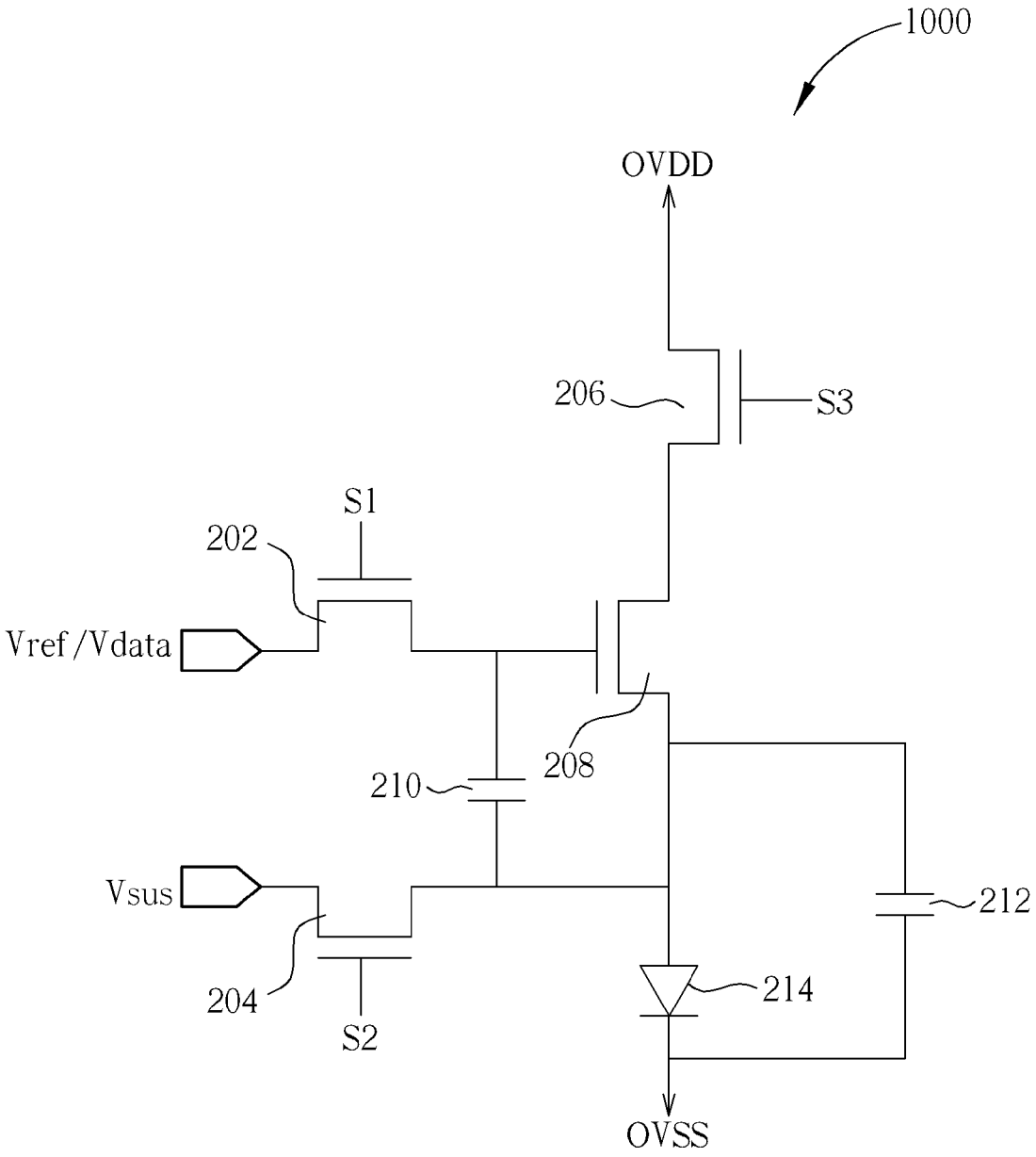
FIG. 10 is a diagram illustrating a driving circuit for pixels of an active matrix organic light-emitting diode display.

In addition, please refer to FIG. 9 and FIG. 10. FIG. 9 is a diagram illustrating a driving circuit 900 for pixels of an active matrix organic light-emitting diode display, and FIG. 10 is a diagram illustrating a driving circuit 1000 for pixels of an active matrix organic light-emitting diode display. A difference between the driving circuit 900 and the driving circuit 200 is that the first terminal of the second capacitor 212 is coupled to the first terminal of the third switch 206, and the second terminal of the second capacitor 212 is coupled to the third terminal of the N-type thin film transistor 208. A difference between the driving circuit 1000 and the driving circuit 200 is that the first terminal of the second capacitor 212 is coupled to the third terminal of the N-type thin film transistor 208, and the second terminal of the second capacitor 212 is coupled to the second terminal of the organic light-emitting diode 214. However, the equation (1) still applies to the driving circuit 900 and the driving circuit 1000. Operational principles of the driving circuit 900 and the driving circuit 1000 are the same as those of the driving circuit 200, so further description thereof is omitted for simplicity.

To sum up, the driving circuit for the pixels of the active matrix organic light-emitting diode display and the method for driving the pixels of the active matrix organic light-emitting diode display utilize the driving circuit having four thin film transistors and two capacitors (4T2C) to generate the driving current independent of process variation of the thin film transistor and the voltage drop of the organic light-emitting diode for reducing differences among the driving currents driving the pixels of the active matrix organic light-emitting diode display. In addition, after utilizing the organic light-emitting diode for a period of time, the voltage drop of the organic light-emitting diode is increased, resulting in decayed luminance of the organic light-emitting diode. However, when the voltage drop of the organic light-emitting diode is increased, the present invention can maintain the driving current of the organic light-emitting diode to improve the decayed luminance of the organic light-emitting diode and uneven luminance of a panel.

Those skilled in the art will readily observe that numerous modifications and alterations of the device and method may be made while retaining the teachings of the invention.

What is claimed is:

1. A driving circuit for pixels of an active matrix organic light-emitting diode display, the driving circuit comprising:

a first switch having a first terminal, a second terminal, and a third terminal, the first terminal for receiving a reference voltage or a data voltage, the second terminal for receiving a first switch signal;

a second switch having a first terminal, a second terminal, and a third terminal, the first terminal for receiving a reset voltage, the second terminal for receiving a second switch signal;

a third switch having a first terminal, a second terminal, and a third terminal, the first terminal for receiving a first voltage, the second terminal for receiving a third switch signal;

an N-type thin film transistor having a first terminal, a second terminal, and a third terminal, the first terminal coupled to the third terminal of the third switch, the second terminal coupled to the third terminal of the first switch, the third terminal coupled to the third terminal of the second switch;

a first capacitor having a first terminal, and a second terminal, the first terminal coupled to the third terminal of the first switch, the second terminal coupled to the third terminal of the second switch;

a second capacitor having a first terminal, and a second terminal, the first terminal coupled to the third terminal of the third switch, the second terminal coupled to the third terminal of the N-type thin film transistor; and an organic light-emitting diode having a first terminal, and a second terminal, the first terminal directly coupled to the third terminal of the N-type thin film transistor, the third terminal of the second switch and the second terminal of the first capacitor, the second terminal coupled to a second voltage;

wherein when the second switch is turned off, the third switches is turned on during a plurality of time intervals.

2. The driving circuit of claim 1, wherein the periods of the operations of the first switch signal, the second switch signal, and the third switch signal are all different.

3. The driving circuit of claim 1, wherein the first capacitor is used for storing a compensation voltage.

4. The driving circuit of claim 1, wherein a variation voltage of the second terminal of the N-type thin film transistor is divided by the first capacitor and the second capacitor.

5. The driving circuit of claim 1, wherein the third switch is used for providing a driving current for the organic light-emitting diode.

6. The driving circuit of claim 5, wherein the data voltage is used for controlling the driving current.

7. The driving circuit of claim 1, wherein the first terminal of the first capacitor is charged/discharged according to turning on and turning off of the first switch.

8. The driving circuit of claim 1, wherein the second terminal of the first capacitor is charged/discharged according to turning on and turning off of the second switch.

9. The driving circuit of claim 1, wherein the reference voltage is higher than the reset voltage.

10. The driving circuit of claim 1, wherein the first switch, the second switch, and the third switch are N-type thin film transistors.

11. A driving circuit for pixels of an active matrix organic light-emitting diode display, the driving circuit comprising:

a first switch having a first terminal, a second terminal, and a third terminal, the first terminal for receiving a reference voltage or a data voltage, the second terminal for receiving a first switch signal;

a second switch having a first terminal, a second terminal, and a third terminal, the first terminal for receiving a reset voltage, the second terminal for receiving a second switch signal;

a third switch having a first terminal, a second terminal, and a third terminal, the first terminal for receiving a first voltage, the second terminal for receiving a third switch signal;

an N-type thin film transistor having a first terminal, a second terminal, and a third terminal, the first terminal coupled to the third terminal of the third switch, the second terminal coupled to the third terminal of the first switch, the third terminal coupled to the third terminal of the second switch;

a first capacitor having a first terminal, and a second terminal, the first terminal coupled to the third terminal of the first switch, the second terminal coupled to the third terminal of the second switch;

a second capacitor having a first terminal, and a second terminal, the first terminal coupled to the first terminal of the third switch, the second terminal coupled to the third terminal of the N-type thin film transistor; and an organic light-emitting diode having a first terminal, and a second terminal, the first terminal directly coupled to the third terminal of the N-type thin film transistor, the third terminal of the second switch and the second terminal of the first capacitor, the second terminal coupled to a second voltage;

wherein when the second switch is turned off, the third switch is turned on during a plurality of time intervals.

12. A driving circuit for pixels of an active matrix organic light-emitting diode display, the driving circuit comprising:

a first switch having a first terminal, a second terminal, and a third terminal, the first terminal for receiving a reference voltage or a data voltage, the second terminal for receiving a first switch signal;

a second switch having a first terminal, a second terminal, and a third terminal, the first terminal for receiving a reset voltage, the second terminal for receiving a second switch signal;

a third switch having a first terminal, a second terminal, and a third terminal, the first terminal for receiving a first voltage, the second terminal for receiving a third switch signal;

an N-type thin film transistor having a first terminal, a second terminal, and a third terminal, the first terminal coupled to the third terminal of the third switch, the second terminal coupled to the third terminal of the first switch, the third terminal coupled to the third terminal of the second switch;

a first capacitor having a first terminal, and a second terminal, the first terminal coupled to the third terminal of the first switch, the second terminal coupled to the third terminal of the second switch;

a second capacitor having a first terminal, and a second terminal, the first terminal coupled to the third terminal of the N-type thin film transistor, the second terminal coupled to the second terminal of the organic light-emitting diode; and an organic light-emitting diode having a first terminal, and a second terminal, the first terminal directly coupled to the third terminal of the N-type thin film transistor, the third terminal of the second switch and the second terminal of the first capacitor, the second terminal coupled to a second voltage;

wherein when the second switch is turned off, the third switch is turned on during a plurality of time intervals.

13. A method utilizing the driving circuit of claim 1 to drive the pixels of the active matrix organic light-emitting diode display, the method comprising:

charging the first terminal of the first capacitor and the second terminal of the first capacitor according to the reference voltage and the reset voltage respectively, and turning on the third switch at the same time, wherein the reference voltage is higher than the reset voltage;

floating the second terminal of the first capacitor, and turning on the third switch to charge the second terminal of the first capacitor at the same time;

charging the first terminal of the first capacitor according to the data voltage and turning off the third switch; and floating the first terminal of the first capacitor and turning on the third switch.

14. The method of claim 13, wherein the reference voltage charges the first terminal of the first capacitor through the first switch, and the reset voltage charges the second terminal of the first capacitor through the second switch.

15. The method of claim 13, wherein floating the second terminal of the first capacitor is turning off the second switch to float the second terminal of the first capacitor.

16. The method of claim 13, wherein after floating the second terminal of the first capacitor, a voltage of the second terminal of the N-type thin film transistor is the reference voltage and a voltage of the third terminal of the N-type thin film transistor is given by:

$$Vs = Vref - Vt;$$

wherein

Vs is a voltage of the second terminal of the first capacitor;

Vref is the reference voltage; and

Vt is a threshold voltage of the N-type thin film transistor.

17. The method of claim 13, wherein after charging the first terminal of the first capacitor according to the data voltage and turning off the third switch, the voltage of the second terminal of the N-type thin film transistor is the data voltage and the voltage of the third terminal of the N-type thin film transistor is given by:

$$V_s = Vref - Vt + a(Vdata - Vref),$$

$$a = \frac{C1}{C1 + C2};$$

wherein

Vdata is the data voltage; and

C1 is a value of the first capacitor and C2 is a value of the second capacitor.

18. The method of claim 13, wherein after floating the first terminal of the first capacitor and turning on the driving current to drive the organic light-emitting diode, the voltage of the second terminal of the N-type thin film transistor and the voltage of the third terminal of the N-type thin film transistor are given by:

$$V_G = Vdata + Vt - Vref - a(Vdaa - Vref) + OVSS + VOLED,$$

$$a = \frac{C1}{C1 + C2};$$

and $$V_S = OVSS + VOLED;$$

wherein $V_G$ is the voltage of the second terminal of the N-type thin film transistor;

C1 is the value of the first capacitor and C2 is the value of the second capacitor;

OVSS is a terminal voltage of the organic light-emitting diode; and

VOLED is a voltage drop of the organic light-emitting diode.

* * * * *